US012134007B1

(12) United States Patent
Anderson et al.

(10) Patent No.: US 12,134,007 B1
(45) Date of Patent: Nov. 5, 2024

(54) FINGER STRENGTHENING DEVICE AND METHOD

(71) Applicant: Government of the United States, as represented by the Secretary of the Air Force, Wright-Patterson AFB, OH (US)

(72) Inventors: Michael Anderson, Colorado Springs, CO (US); Christopher Klinke, Lafayette, CO (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 18/380,290

(22) Filed: Oct. 16, 2023

Related U.S. Application Data

(63) Continuation of application No. 17/468,737, filed on Sep. 8, 2021, now Pat. No. 11,850,469.

(60) Provisional application No. 63/086,104, filed on Oct. 1, 2020.

(51) Int. Cl.
*A63B 23/16* (2006.01)
*A63B 21/00* (2006.01)

(52) U.S. Cl.
CPC ..... *A63B 23/16* (2013.01); *A63B 21/4035* (2015.10); *A63B 21/4045* (2015.10)

(58) Field of Classification Search
CPC ..... A63B 23/16; A63B 21/4035; A63B 21/4045
See application file for complete search history.

(56) References Cited

U.S. PATENT DOCUMENTS

| | | | | |
|---|---|---|---|---|
| 8,500,605 | B2 | 8/2013 | Skipper | |
| 9,468,805 | B2 | 10/2016 | White | |
| 9,855,478 | B2 | 1/2018 | Polig | |
| 10,894,185 | B2 * | 1/2021 | Curry | A63B 21/068 |
| 2011/0319230 | A1 * | 12/2011 | Brendle | A63B 21/169 482/37 |
| 2013/0184124 | A1 * | 7/2013 | Reed | A63B 21/1627 482/37 |
| 2016/0243422 | A1 | 8/2016 | Polig | |
| 2019/0247714 | A1 * | 8/2019 | Curry | A63B 21/068 |
| 2021/0106895 | A1 * | 4/2021 | Gopalakrishnan | A63B 23/12 |
| 2022/0126168 | A1 * | 4/2022 | Riveros Salazar | A63B 23/16 |

* cited by examiner

*Primary Examiner* — Andrew S Lo
(74) *Attorney, Agent, or Firm* — AFMCLO/JAZ; Matthew D. Fair

(57) ABSTRACT

A finger strengthening device (FSD) includes a plurality of finger strengthening elements formed therewith. The FSD is attachable to a structure in a plurality of different orientations to permit a variation in finger exercise techniques.

17 Claims, 8 Drawing Sheets

FINGER STRENGTHENING DEVICE AND METHOD

This is a Continuation Application of application Ser. No. 17/468,737 filed on Sep. 8, 2021, which in turn claims the benefit of and priority to prior filed and Provisional Application Ser. No. 63/086,104, filed Oct. 1, 2020 which is expressly incorporated herein by reference.

RIGHTS OF THE GOVERNMENT

The invention described herein may be manufactured and used by or for the Government of the United States for all governmental purposes without the payment of any royalty.

TECHNICAL FIELD

The present disclosure generally relates to a finger strengthening device and a method for using the finger strengthening device.

BACKGROUND

Finger strengthening devices can be used as training for rock climbers, military personnel or other similar athletic endeavors. Typically, finger strengthening devices are fixed in orientation and therefore have limited capability. It is desirable to provide additional capability over prior art finger strengthening devices accordingly, there remains a need for further contributions in this area of technology.

SUMMARY

One embodiment of the present disclosure includes a unique finger strengthening device. Other embodiments include apparatuses, systems, devices, hardware, methods, and combinations wherein a finger strengthening device can be reoriented to provide additional finger exercising and strengthening techniques. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
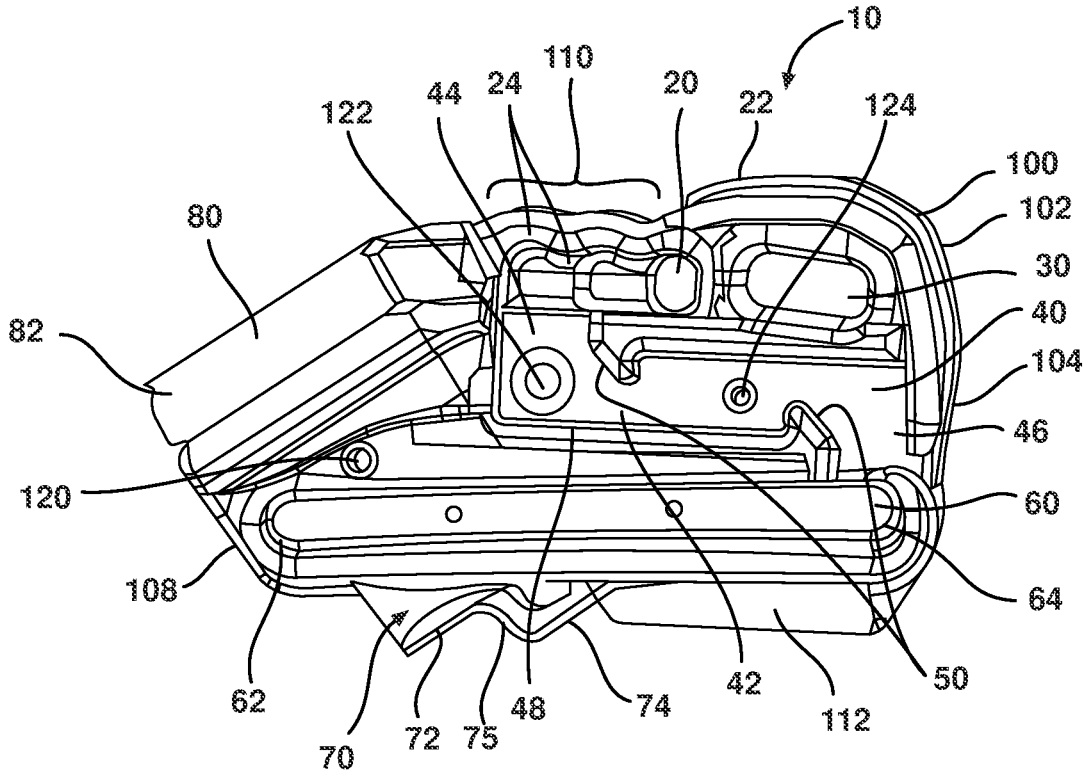
FIG. 1 is a perspective view of a finger strengthening device according to one embodiment of the present disclosure.
Figure 2:
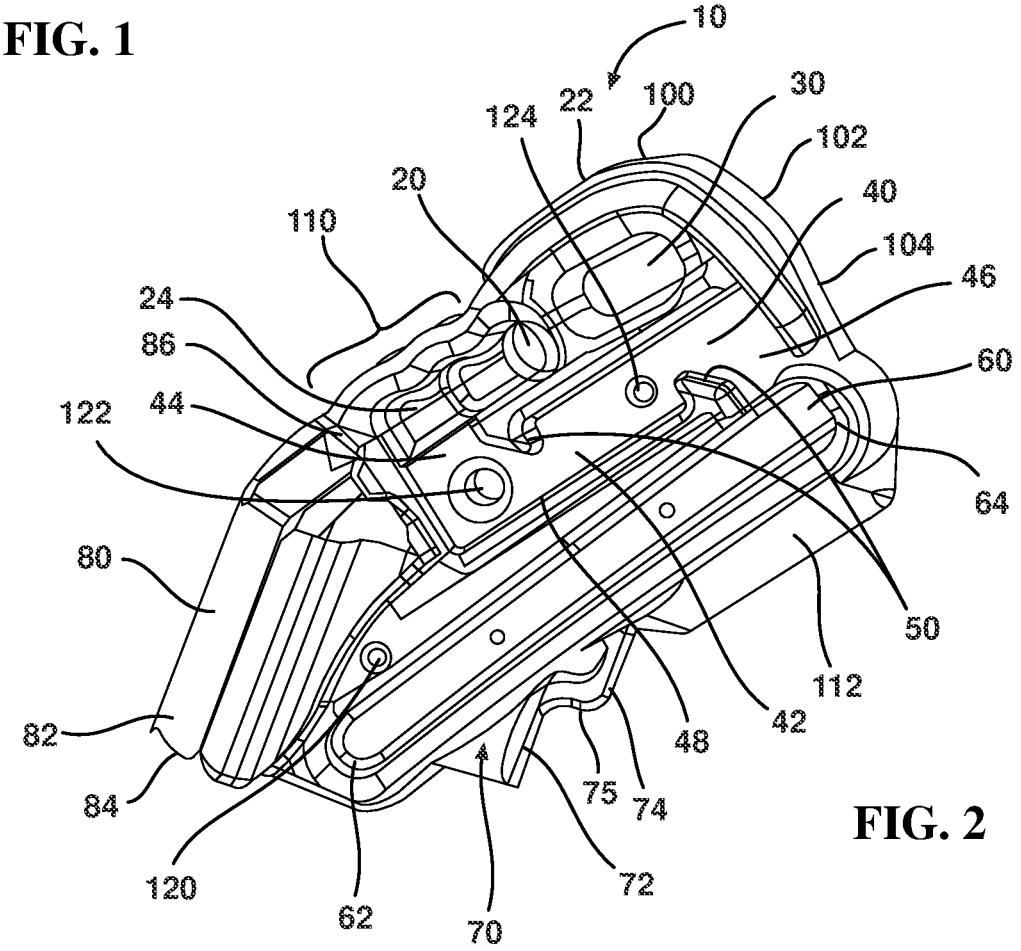
FIG. 2 is another perspective view of the finger strengthening device of FIG. 1.
Figure 3:
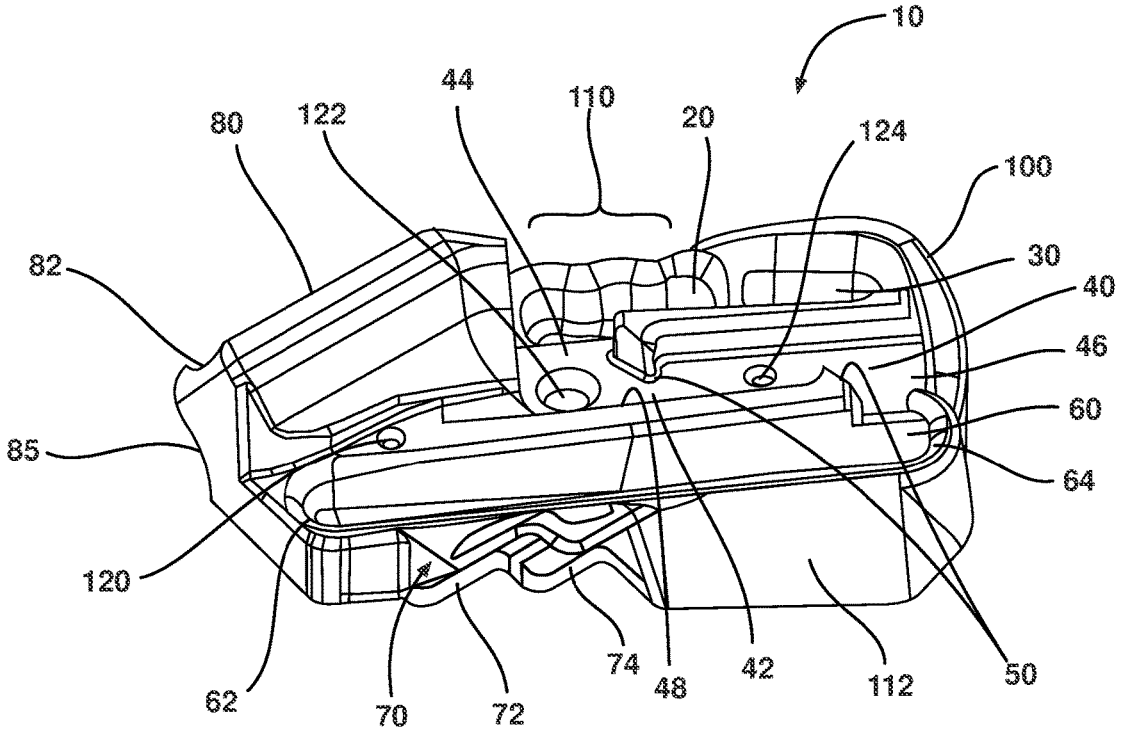
FIG. 3 is another perspective view of the finger strengthening device of FIG. 1.
Figure 4:
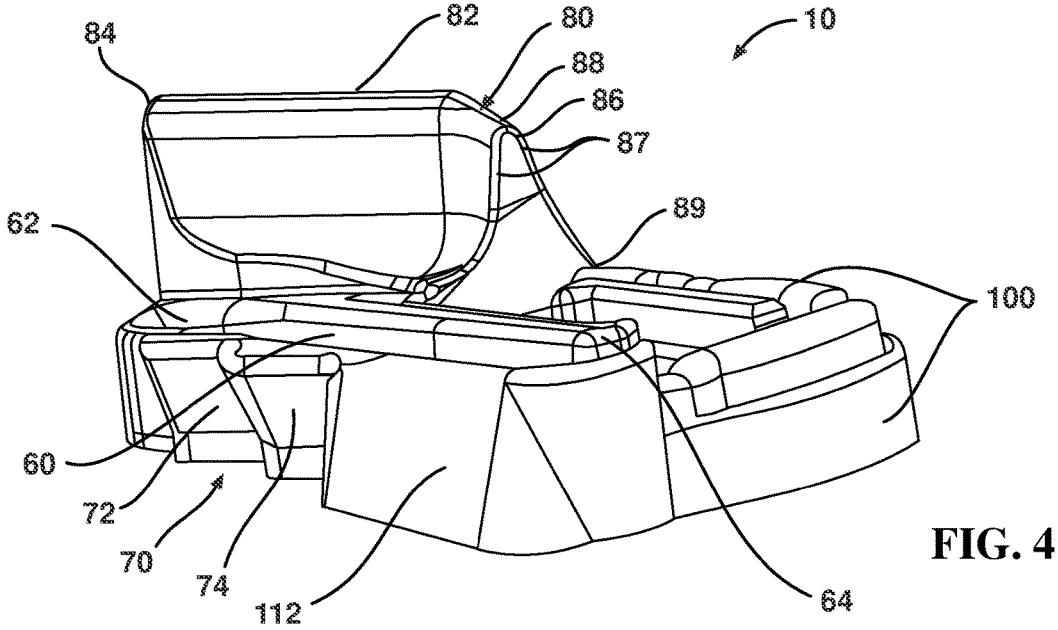
FIG. 4 is another perspective view of the finger strengthening device of FIG. 1.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring generally to FIGS. 1-5, various perspective views of a finger strengthening device (FSD) 10 according to one embodiment of the present disclosure is depicted. The FSD 10 has various slots and grips that enable an individual to engage while hanging from to train finger muscles for rock climbing or the like. It should be understood that directional annotations such as top side, bottom side, left side, right side, above, below or other similar descriptors are relative to the view shown and do not define the FSD 10 in absolute terms. As it will be explained in more detail, the FSD 10 can be rotated in a plurality of different orientations and therefore the top side 22 may be rotated to the left, right, bottom, or at any intermediate position therebetween.

The FSD 10 includes a triple finger slot 20 proximate a top side 22 thereof. The triple finger slot 20 includes a variable contoured wall 24 configured to receive insertion of up to three fingers during training. A double finger slot 30 is positioned adjacent to the triple finger slot 20. The double finger slot 30 is substantially oval in shape and is sized to receive insertion of one or two fingers therein. An S-shaped track 40 is formed in the FSD 10 just below the triple finger slot 20 and double finger slot 30. The S-shaped track 40 includes a substantially straight section 42 with a first leg 44 extending upward at one end and a second leg 46 extending downward at the opposite end thereof. A perimeter track wall 48 defines the boundary of the S-shaped track 40. The perimeter track wall 48 has a pair of angled track wall ledges 50 formed proximate opposing ends thereof that extend into the straight section 42 and define a transition to the first and second legs 42, 44, respectively. One to four fingers can be engaged within the S-shaped track 40 anywhere along the track while the thumb can be engaged on the angled ledges 50.

An elongate slot 60 is formed in the FSD 10 below the S-shaped track 40. The elongate slot 60 is gently curved at a radius equivalent to that of the user's outstretched arm and extends along a width of the FSD 10 between a first end 62 and a second end 64. The length of the elongate slot 60 is sized to permit up to four fingers to engage therein at three distinct locations during an exercise workout. The depth of the elongate slot 60 increases from the first end 62 to the second end 64, providing three distinct engagement surfaces of varying depth.

A step grip 70 is formed on the lower end of the FSD 10 just below the elongate slot 60. The step grip 70 includes a first step 72 and a second step 74 formed at a different height with a riser wall 75 extending therebetween. The step grip 70 can be used when the FSD 10 is rotated to move the step grip 70 away from the bottom to one of the sides or to the top side. When rotated to the left side the riser wall 75 can provide a grip surface for one or more fingers to engage therewith.

An angled grip 80 protrudes outward at the upper left hand side as viewed in FIG. 1. The angled grip 80 extends between first and second ends 84, 86 respectively (best seen in FIG. 4). The angled grip 80 includes a substantially straight and flat top wall 82 that transitions to a downwardly tapered top wall 88 from the first end 84 to the second end 86. The angled grip 80 includes opposing inwardly sloped sidewalls 87 projecting from a base 89 to the top wall 82.

Figure 15:
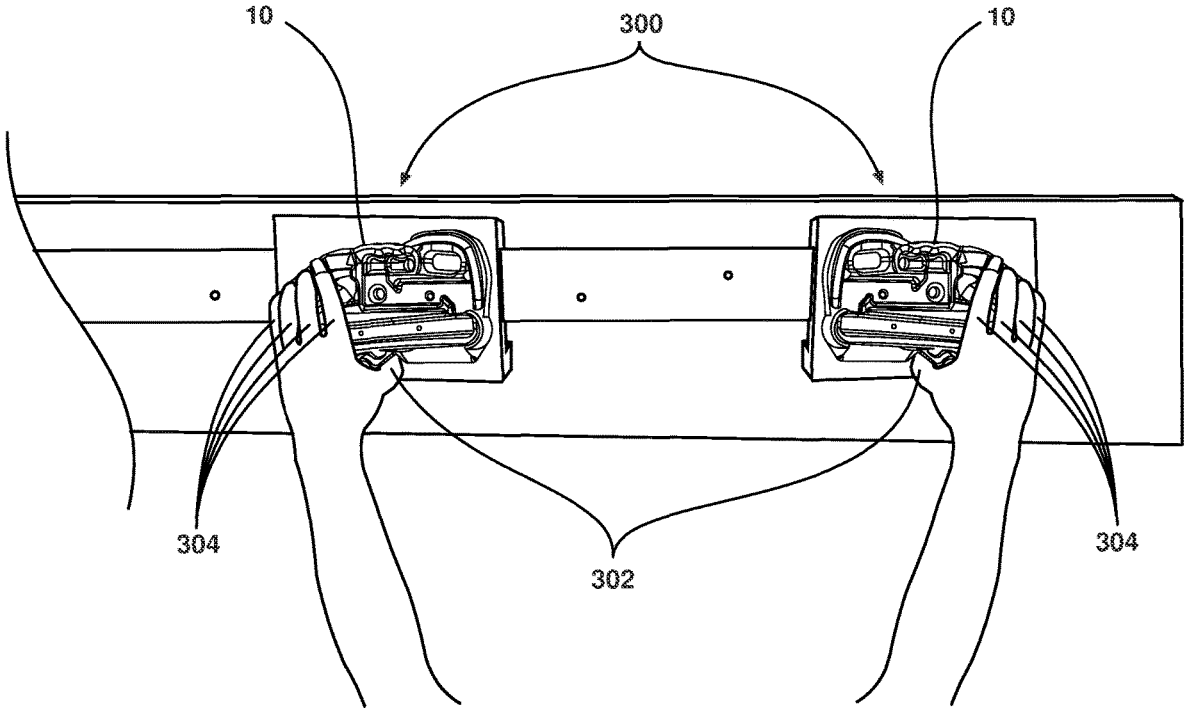
FIG. 15 is a front perspective view of a left and right handed pinch grip.

The angled grip 80 can be used concurrently with the step grip 70 to create a pinch grip. The fingers rest on the flat surface 82 of the angled grip 80, while the thumb rests on either the first step 72 or second step 74 to create narrower, or wider pinch grips, respectively. The pinch grip is usable when the FSD 10 is in the first orientation 250 shown in FIG. 11. A view of a two handed pinch grip is shown in FIG. 15 and is described further below. An outer perimeter wall 100 of the FSD 10 has variable features and construction at different locations there about. A curved perimeter wall portion 102 is formed along the upper right portion as viewed in FIG. 1. A relative straight portion 104 of the perimeter wall 100 extends from the curved portion 102 along the right side of the FSD 10. A variable slope portion 110 of the perimeter wall 100 is positioned at the top of the FSD just above the triple finger slot 20. The outer sloped side wall 87 of the angled grip 80 forms another portion of the perimeter wall 100 adjacent the variable slope portion 110. The perimeter wall 100 transitions to a relative straight portion 108 on the left side of the FSD 10 then to the step grip 70 and finally a flat portion 112 terminating at the right end thereof.

The FSD 10 includes a plurality of through apertures to facilitate fastening to a wall or other structure. A threaded fastener (not shown) or the like can extend through one or more of the through apertures and thread into a support structure. A first aperture 120 is formed above the elongate slot 60 proximate the second end 62 thereof. A second aperture 122 is formed through the S-shaped track 40 proximate the first leg 44 thereof. A third aperture 124 is formed through the straight section 42 of the S-shaped track 40. It should be noted that one or more of the apertures 120, 122 and/or 124 can be used to fasten the FSD 10 to a structure. Further, other through apertures may be formed in the FSD 10 in addition or in lieu of the first, second and third apertures 120, 122, 124.

Figure 5:
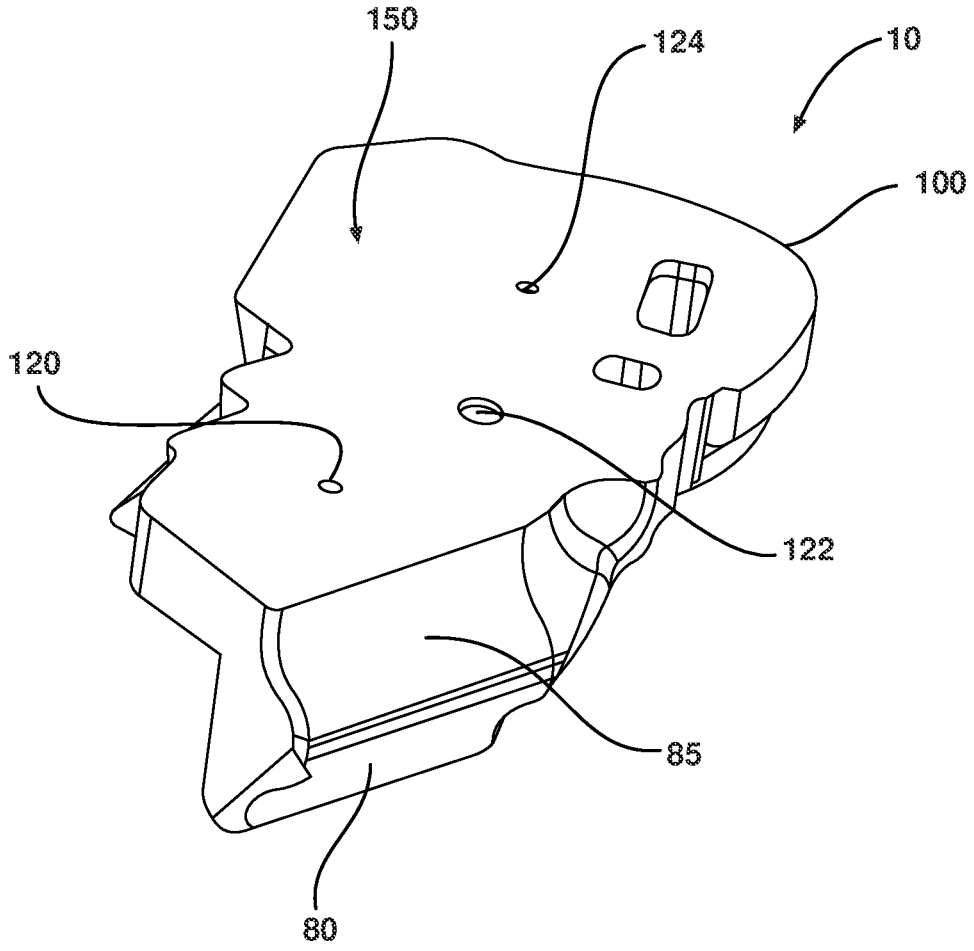
FIG. 5 is a perspective view of a back side of the finger strengthening device of FIG. 1.

Referring now more particularly to FIG. 5, a perspective view of the FSD 10 is rotated to show the back wall 150. The back wall 150 is substantially flat so that the FSD 10 can set flush with a quad cleat 200 or a structural wall (not shown). The through apertures 120, 122 and 124 can be seen extending through the backwall 150. One or more of these through apertures can receive a mechanical fastener to connect to another structure.

Figure 6:
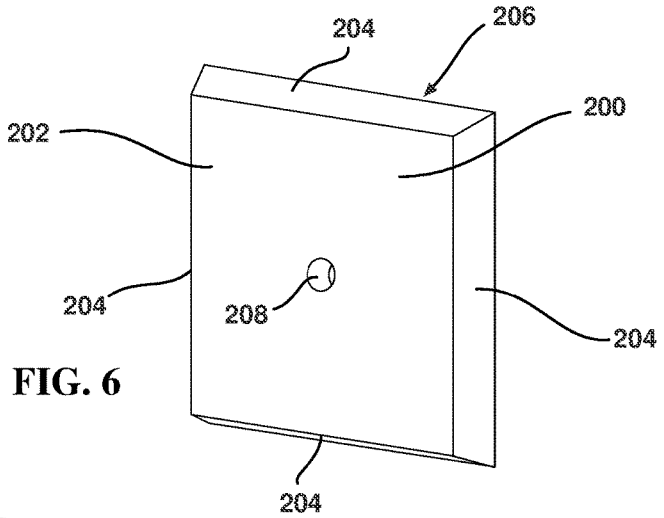
FIG. 6 is a perspective view of a quad cleat for the finger strengthening device of FIG. 1.

Referring now to FIG. 6, a quad cleat 200 configured to connect to an FSD 10 is illustrated. The quad cleat 200 includes a front face 202 and an opposing back face 206. A plurality of angled side walls 204 extend from the front face 202 to the back face 206. A through hole 208 may be formed in the quad cleat through the front and back face 202, 206 as shown. In other embodiments additional through holes may be formed in the quad cleat 200. One or more threaded fasteners (not shown) may be positioned through FSD 10 and the quad cleat 200 and locked in place with a threaded nut as is conventional. In other embodiments the quad cleats 200 may include blind threaded holes to directly receive a threaded fastener.

Figure 7:
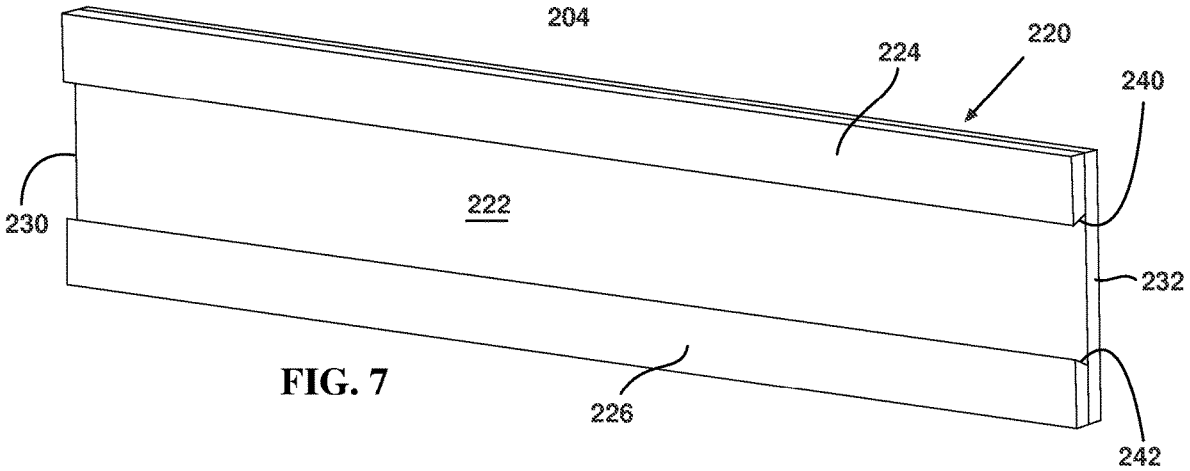
FIG. 7 is a front perspective view of a mounting rail for the finger strengthening device of FIG. 1.
Figure 8:
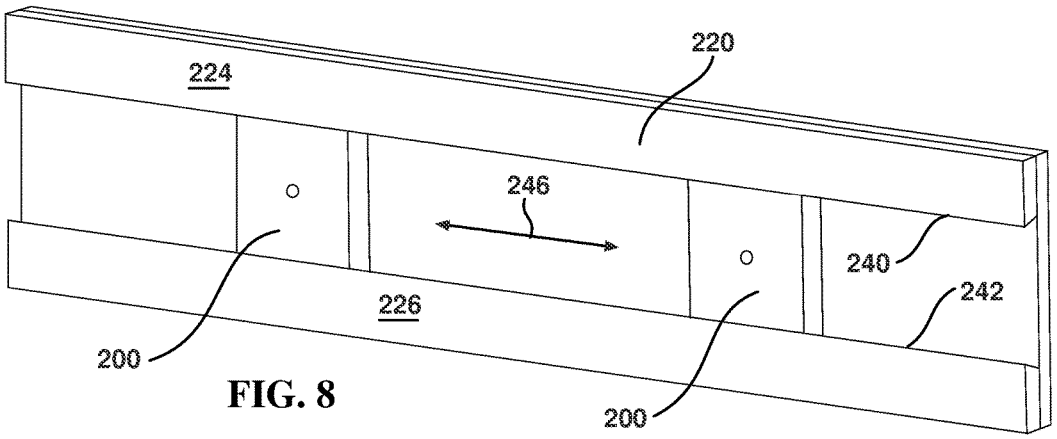
FIG. 8. is another perspective view of the mounting rail of FIG. 7 with the quad cleats of FIG. 6 engaged therewith.

FIG. 7 is a perspective view of a mounting rail 220 configured to hold one or more quad cleats 200 in a desired position. The mounting rail 220 includes a base plate 222 with a top rail 224 and a bottom rail 226 connected thereto. The mounting rail 220 extends from a first end 230 to a second end 232. A top tapered groove 240 is formed in the bottom of the top rail 224 and a bottom tapered groove 242 is formed in the top of the bottom rail 226. FIG. 8 shows a pair of quad cleats 200 coupled to a mounting rail 220. The angled walls 204 of the quad cleats are slid into the top tapered groove 240 and the bottom tapered groove 242. The tapered grooves 240, 242 permit sliding of the quad cleats 200 sideways in the direction of double arrow 246 while preventing the quad cleats 200 from falling out or otherwise disengaging from the mounting rail 220. The mounting rail 220 can be attached to a structure such as a wall or other vertical/angled structure.

Figure 9:
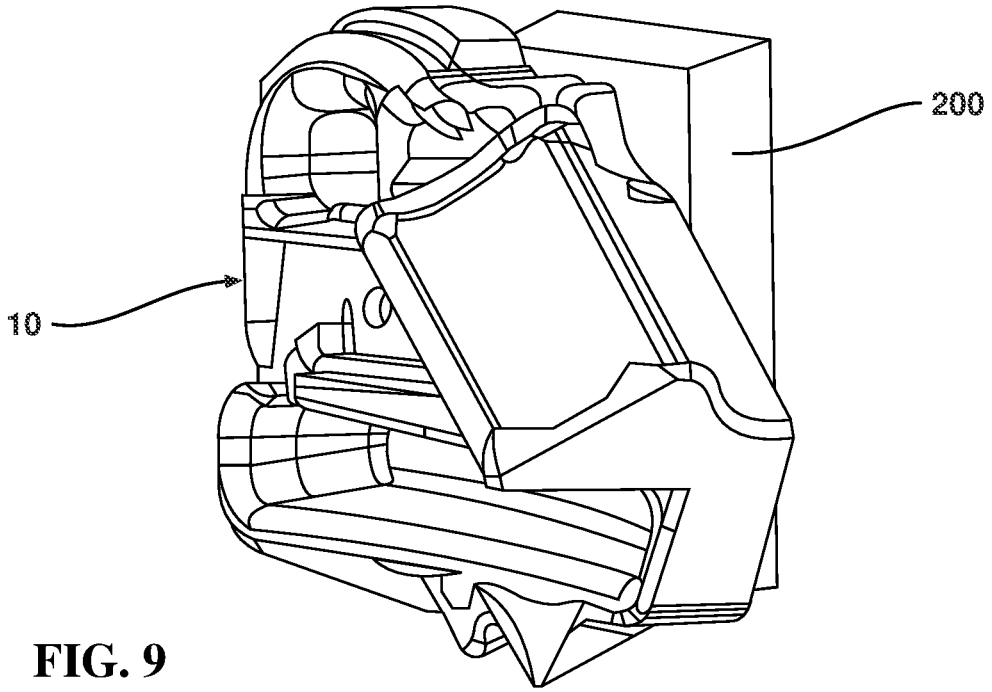
FIG. 9 is a perspective view of the finger strengthening device connected to an quad cleat.
Figure 10:
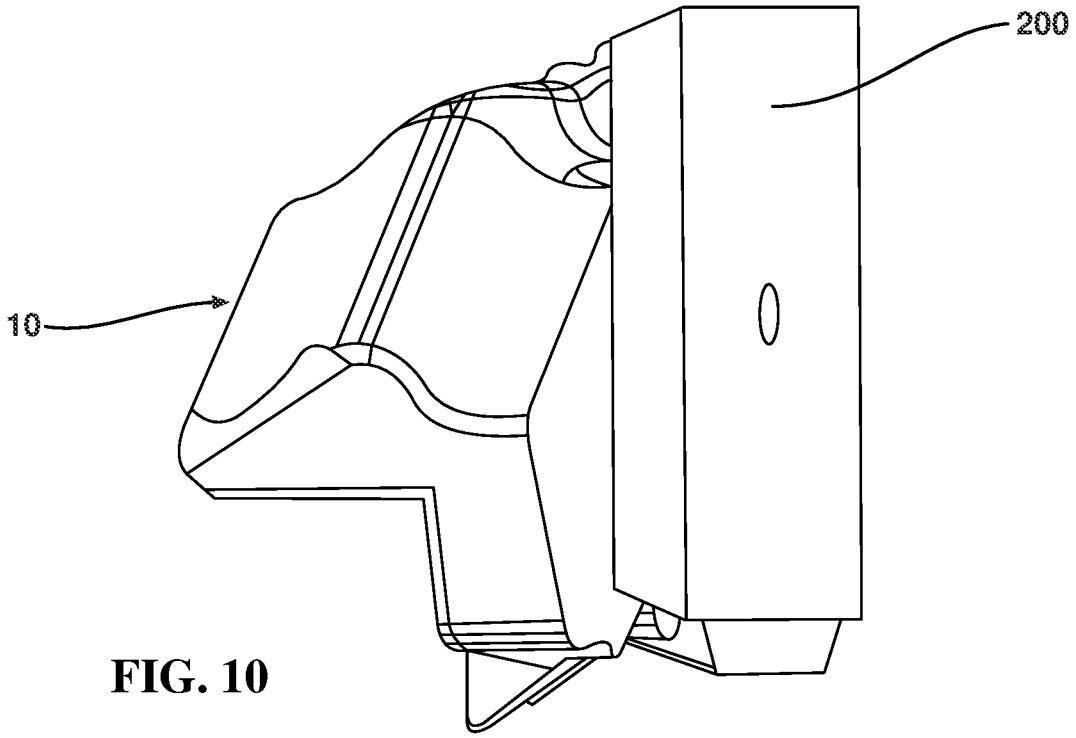
FIG. 10 is another perspective view of the finger strengthening and quad cleat.
Figure 11:
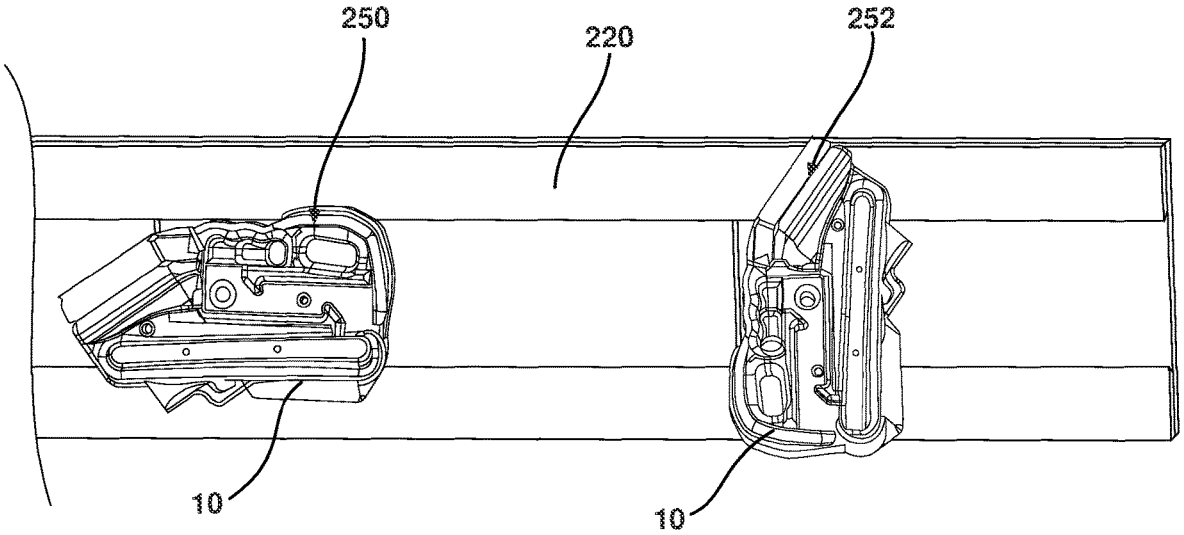
FIG. 11 is a perspective view of a pair of finger strengthening devices connected to quad cleats being engaged with a mounting rail in different orientations.

FIGS. 9 and 10 are front and back perspective views of the FSD 10 connected to a quad cleat 200. FIG. 11 shows one FSD 10 in a first orientation 250 and another FSD 10 in a second orientation 252. While two different orientations are shown it should be understood that the FSD 10 can be positioned and locked into any orientation relative to the quad cleat 200 including a symmetrical orientation. The quad cleat may be rotated in 90 degree increments and slid into place on the mounting rail 220 and thus provide a plurality of different configurations to provide a range of finger training exercises.

Figure 12:
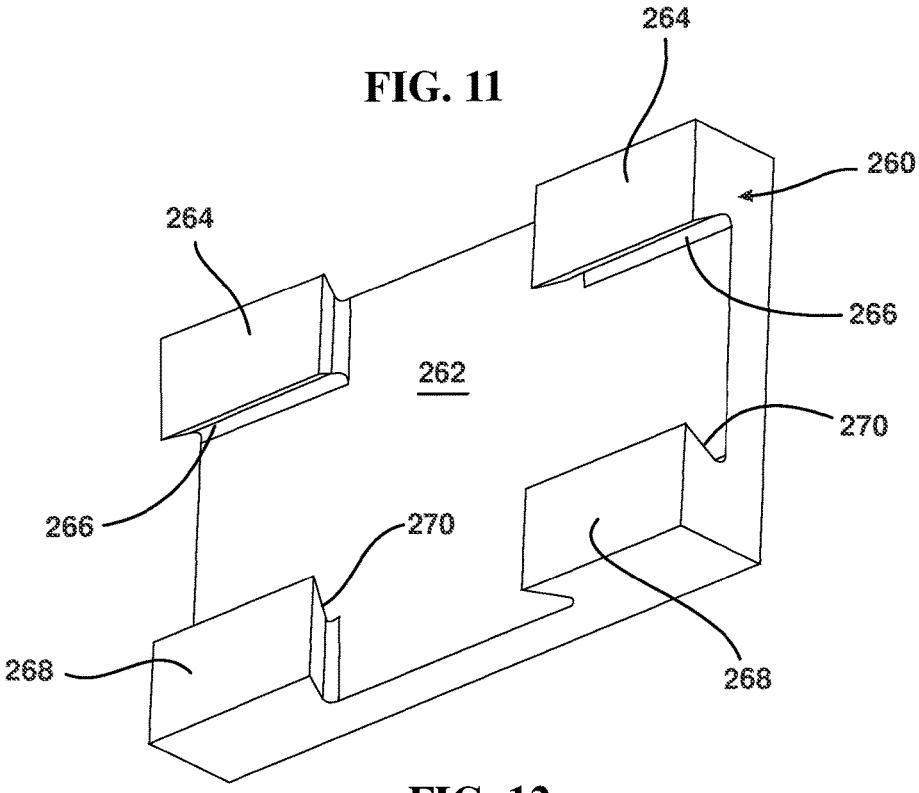
FIG. 12 is a perspective view of a quad cleat according to an alternate embodiment.
Figure 13:
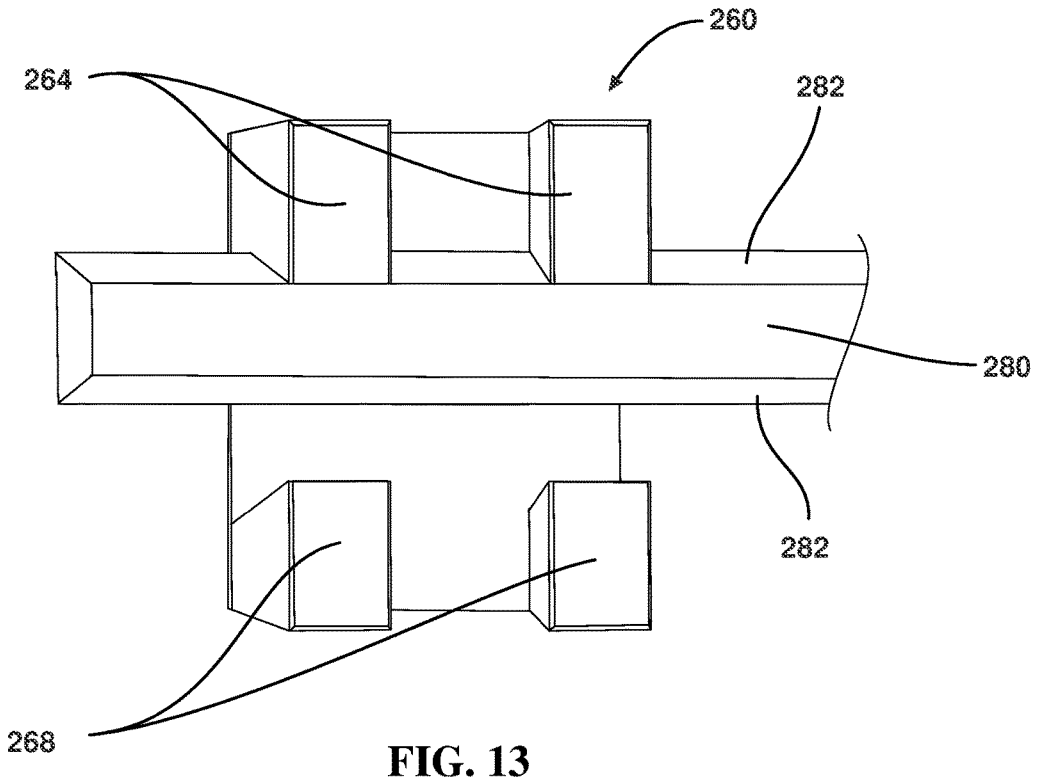
FIG. 13 is a back perspective view of the quad cleat of FIG. 12 engaged with a mounting rail.
Figure 14:
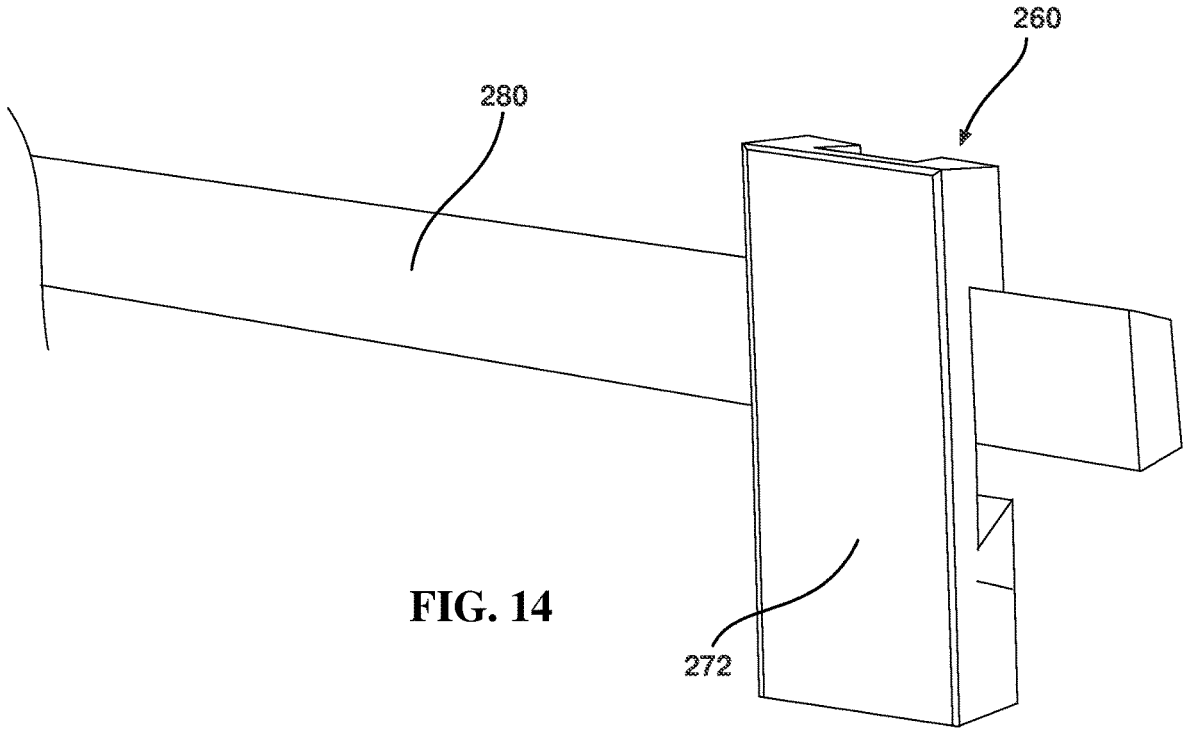
FIG. 14 is a front perspective view of the mounting rail and quad cleat of FIG. 13.

FIG. 12 is a perspective view of a quad cleat 260 in an alternate embodiment of the present disclosure. The quad cleat 260 includes a base 262 with a pair of top segments 264 and a pair of bottom segments 268 protruding outward therefrom. In one embodiment, the top segments 264 and the bottom segments 268 are all identical, however in alternate embodiments the top segments 264 and the bottom segments 268 need not be identical in size or shape. The top segments 264 include a tapered groove 266 on the bottom side and inner side thereof to slidingly receive a mounting rail. The bottom segments 268 include a tapered groove 270 on the top side and inner side thereof to slidingly receive an opposing side of a mounting rail. FIGS. 13 and 14 show a back perspective view and a front perspective view of the mounting rail 280 and quad cleat 260, respectively. The mounting rail 280 which can be permanently fixed to a structural wall (not shown), includes angled side walls 282 that are configured to slidingly engage with the grooves 266, 270 of the quad cleat 260 so that the FSD 10 (not shown) can be removably attached to a wall or other structure. As with the embodiment shown in FIGS. 6-8 the quad cleat 260 can be rotated in 90 degree increments to change the orientation of the FSD 10.

FIG. 15 illustrates a pinch grip 300 that was previously discussed in this application. The pinch grip 300 is defined by a thumb being engaged with the step grip 70 (See FIG. 1) and one or more fingers 304 engaged with the angled grip 80. The pinch grip 300 requires climbers to squeeze two surfaces between the thumb and fingers. The shape and orientation of the pinch grip 300 provides an ergonomic grip position without the need for excessive volume. In the exemplary embodiment, the pinching surfaces 70, 80 (step grip and angled grip) are rotated outward approximately 30° to improve alignment between shoulders, elbows and wrists. The pinching surfaces are also rotated downward approximately 35° to improve wrist alignment and create a greater physical challenge, and thus, more realistic simulation of rock climbing grips. It should be understood that other angels and orientations for the pinch grip 300 may be implemented and remain within the scope of the present invention. The combination of two such rotations is effective at safely improving pinch grip strength. Incorporated into the angle grip 80 is a jug grip 85, an easier grip that allows climbers to warmup or perform pull-ups, etc., illustrated in FIGS. 3 and 5. Incorporating the Jug grip into the angled grip 80 provides a more compact design that requires less material. The Jug grip 85 is provided by the inclusion of a cavity opposite the angled grip 80 that allows the climber's fingers to wrap over the top of and behind the angled grip 80, providing an easier handhold. Material selection for the FSD 10, quad cleats 200, 260 and mounting rails 220, 280 can include, but are not limited to plastics, metals, metal alloys, wood, composites or combinations thereof.

In one aspect the present disclosure incudes a finger strengthening system comprising: a finger strengthening device (FSD); a plurality of elements formed into the FSD to permit finger engagement; and a quad cleat connectable to the FSD in one of a plurality of orientations.

In refining aspects the finger strengthening system comprises a mounting rail configured to engage and hold the quad cleat in position; wherein the quad cleat can engage the mounting rail in a plurality of orientations; wherein the quad cleat includes a plurality of angled sidewalls; wherein the mounting rail includes tapered grooves configured to slidingly receive the angled sidewalls of the quad cleat; wherein a plurality of FSDs are attached to the mounting rail with quad cleats; wherein each of the plurality of FSDs are attached in a different orientation with respect to one another; wherein each of the plurality of FSDs can be disengaged, rotated and reengaged with the mounting rail; wherein the elements include a triple finger slot, a double finger slot, an S-shaped track and an elongate slot; and wherein the elements include an angled grip and a step grip.

In another aspect, a finger strengthening device (FSD) comprises: a plurality of finger strengthening elements formed therewith; at least one through aperture configured to receive a mechanical fastener; and wherein the FSD is attachable to a structure in a plurality of different orientations.

In refining aspects, one of the elements include an angled grip; one of the elements include a step grip; wherein the angled grip and the step grip form a pinch grip; one of the elements include an elongate slot; one of the elements include an S-shaped track; one of the elements include a triple finger slot; and one of the elements include a double finger slot.

In another aspect a method for strengthening fingers comprises: attaching a finger strengthening device (FSD) in a first orientation to a structure; engaging one or more fingers with the FSD in the first orientation during a first finger exercise; changing the FSD to a second orientation with respect to the structure; engaging one or more fingers with the FSD in the second orientation during a second finger exercise.

In refining aspects, engaging the FSD includes performing a finger exercise on one or more of a plurality of elements; changing the orientation of the FSD includes: sliding an quad cleat connected to the FSD out of engagement with a mounting rail; rotating the quad cleat and FSD; sliding the quad cleat back into engagement with the mounting rail such that the FSD is positioned in a different orientation relative to an initial orientation; further comprising attaching a second FSD to the structure; and wherein the second FSD is oriented in a different position relative to the FSD.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A finger strengthening system comprising:

a finger strengthening device (FSD);

a plurality of different elements formed into the FSD to permit a plurality of different finger engagements;

a quad cleat rotatably connectable to the FSD and fixed in one of a plurality of angular orientations;

a mounting rail configured to engage and hold one or more quad cleats in position; and wherein each of a plurality of FSDs are attached to the mounting rail with a respective quad cleat.

2. The finger strengthening system of claim 1, wherein the quad cleat can engage the mounting rail in a plurality of orientations.

3. The finger strengthening system of claim 1, wherein the quad cleat includes a plurality of angled sidewalls.

4. The finger strengthening system of claim 3, wherein the mounting rail includes tapered grooves configured to slidingly receive the angled sidewalls of the quad cleat.

5. The finger strengthening system of claim 1, wherein each of the plurality of FSDs are attached in a different orientation with respect to one another.

6. The finger strengthening system of claim 5, wherein each of the plurality of FSDs can be disengaged, rotated and reengaged with the mounting rail.

7. The finger strengthening system of claim 1, wherein the elements include a triple finger slot, a double finger slot, an S-shaped track and an elongate slot.

8. The finger strengthening system of claim 1, wherein the elements include an angled grip and a step grip.

9. A finger strengthening device (FSD) comprising:

a plurality of finger strengthening elements formed therewith;

at least one through aperture configured to receive a mechanical fastener to attach the FSD to a structure;

wherein the plurality of finger strengthening elements include an S-shaped track and one or more of the following elements: an angled grip, a step grip, an elongate slot, a triple finger slot, and a double finger slot; and wherein the S-shaped track is defined by an upward projecting first leg at one end and a downward projecting second leg at an opposing end with a relatively straight section positioned between the first and second legs, and wherein an angled track wall ledge is formed at a transition from each of the first and second legs and the relatively straight section.

10. The FSD of claim 9, wherein the angled grip is defined by a straight flat wall extending from a top side at a downward sloping angle toward a side wall of the FSD.

11. The FSD of claim 9, wherein the step grip is defined by a first step at first height away from a perimeter wall and a second step at a second height away from the perimeter wall separated by a riser wall, wherein the second height is greater than the first height.

12. The FSD of claim 9, wherein the elongate slot is defined by a substantially straight recessed element extending from a first side of the FSD to a second side of the FSD and terminating adjacent a perimeter wall thereof.

13. The FSD of claim 9, wherein the triple finger slot is defined by a variable contoured wall configured to define locations for three individual fingers to engage therewith.

14. The FSD of claim 9, wherein the double finger slot is defined by a recessed oval sized to permit only two fingers to engage therewith.

15. A method for strengthening fingers comprising:

attaching a first finger strengthening device (FSD) to a mounting structure;

attaching a second finger strengthening device (FSD) to the mounting structure;

rotating the first and second FSDs to a desired angular orientation;

holding the first and second FSDs in a fixed angular orientation;

wherein the desired angular orientation can be the same angular orientation or a different angular orientation relative to one another;

engaging one or more fingers from one hand with the first FSD during a finger exercise;

engaging one or more fingers from another hand with the second FSD during the second exercise.

16. The method of claim 15, further comprising exercising fingers by engaging one or more of a plurality of elements formed in the FSD and holding at least a portion of a person's body weight.

17. The method of claim 15, wherein rotating the first and second FSDs to the desired angular orientation includes orienting a quad cleat connected to each FSD to the desired orientation and slidingly engaging an opposing pair of angled sidewalls of the quad cleat with a top rail and bottom rail of the mounting structure.

* * * * *